US010108102B2

(12) United States Patent
Shibata et al.

(10) Patent No.: US 10,108,102 B2
(45) Date of Patent: Oct. 23, 2018

(54) FIXING SOLUTION AND IMAGE FORMING METHOD

(71) Applicant: Konica Minolta, Inc., Tokyo (JP)

(72) Inventors: Koji Shibata, Tokyo (JP); Hiroaki Obata, Tokyo (JP); Natsuko Fujisaki, Tokyo (JP); Anju Hori, Tokyo (JP); Kishio Tamura, Tokyo (JP)

(73) Assignee: Konica Minolta, Inc., Tokyo (JP)

( * ) Notice: Subject to any disclaimer, the term of this patent is extended or adjusted under 35 U.S.C. 154(b) by 266 days.

(21) Appl. No.: 14/811,051

(22) Filed: Jul. 28, 2015

(65) Prior Publication Data

US 2015/0331345 A1 Nov. 19, 2015

Related U.S. Application Data

(62) Division of application No. 13/852,802, filed on Mar. 28, 2013, now abandoned.

(30) Foreign Application Priority Data

Apr. 3, 2012 (JP) ..... 2012-084517

(51) Int. Cl.
*G03G 11/00* (2006.01)
*G03G 9/087* (2006.01)

(52) U.S. Cl.
CPC ..... *G03G 11/00* (2013.01); *G03G 9/08728* (2013.01)

(58) Field of Classification Search
CPC ..... G03G 11/00; G03G 9/08728
See application file for complete search history.

(56) References Cited

U.S. PATENT DOCUMENTS 5,279,655 A * 1/1994 Takazawa ..... B41M 5/10 106/31.43
2004/0220153 A1* 11/2004 Jost-Price ..... A61K 31/565 514/171
2005/0003293 A1* 1/2005 Takano ..... G03G 9/125 430/115

(Continued)

FOREIGN PATENT DOCUMENTS

CN 102103338 A 6/2011
JP 3290513 B2 3/2002

(Continued)

*Primary Examiner* — Peter F Godenschwager
*Assistant Examiner* — Andrew J. Oyer
(74) *Attorney, Agent, or Firm* — Lucas & Mercanti, LLP

(57) ABSTRACT

To provide a fixing solution and an image forming method in which faster fixing rate and faster drying rate can be achieved while the amount of fixing solution supplied is reduced and furthermore, a wet feeling in a formed image is reduced and an image having a high fixing strength can be formed.

A fixing solution that softens a toner to fix a toner image constituted by the toner to an image support contains a hydroxyl group-containing ester compound expressed by general formula (1) below:

$R^1$—(CO)—O—$R^2$ general formula (1):

where $R^1$ represents a linear or branched alkyl group having 6 to 11 carbon atoms, and $R^2$ represents a linear or branched alkyl group having at least one hydroxyl group and 2 to 4 carbon atoms.

11 Claims, 2 Drawing Sheets

(56) References Cited

U.S. PATENT DOCUMENTS

| | | | | |
|---|---|---|---|---|
| 2005/0142153 | A1* | 6/2005 | Schreiber | A61K 8/042 424/401 |
| 2008/0152401 | A1* | 6/2008 | Kimura | G03G 15/2053 399/328 |
| 2009/0067904 | A1* | 3/2009 | Katano | G03G 15/2096 399/339 |
| 2011/0294746 | A1 | 12/2011 | Carli et al. | |
| 2012/0045482 | A1 | 2/2012 | Raghavan | |
| 2012/0252793 | A1* | 10/2012 | Bream | A61K 31/5513 514/221 |

FOREIGN PATENT DOCUMENTS

| | | | |
|---|---|---|---|
| JP | 4302700 | B2 | 5/2009 |
| JP | 4358896 | B2 | 8/2009 |
| JP | 2011128457 | A | 6/2011 |

* cited by examiner

[Fig. 1]
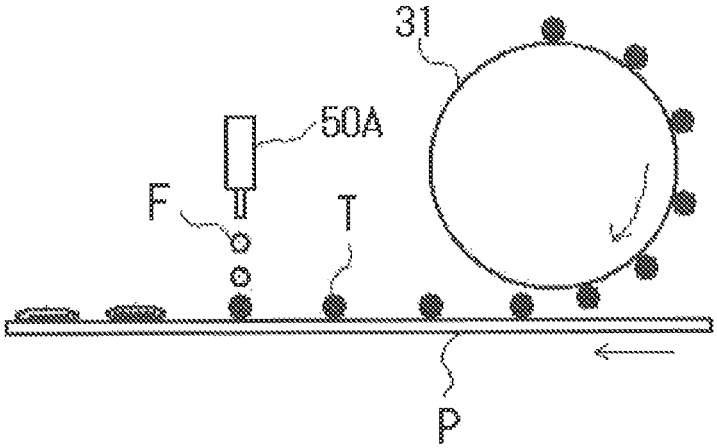
[Fig. 2]
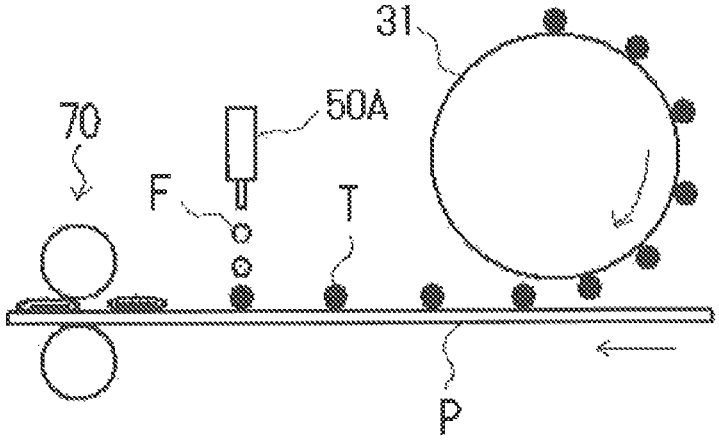
[Fig. 3]
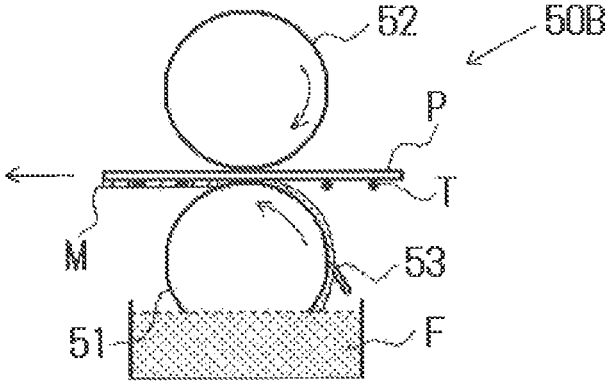

[Fig. 4]
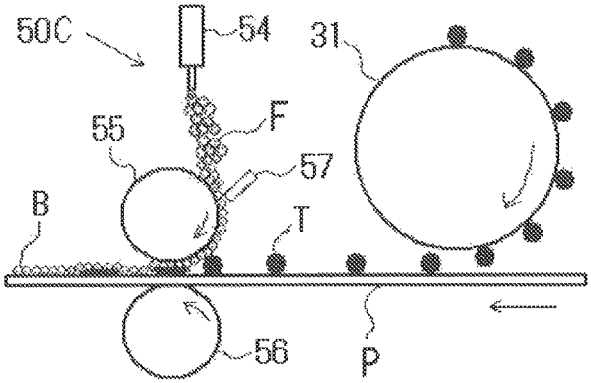
[Fig. 5]
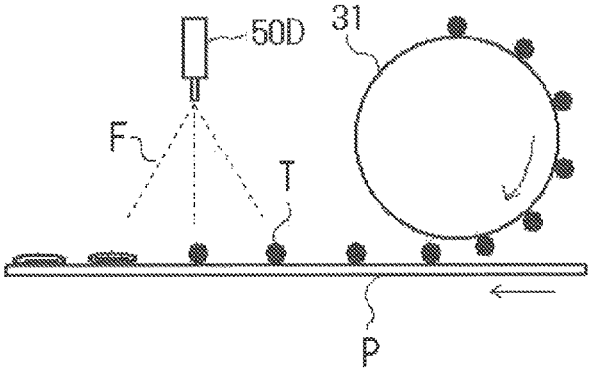
[Fig. 6]
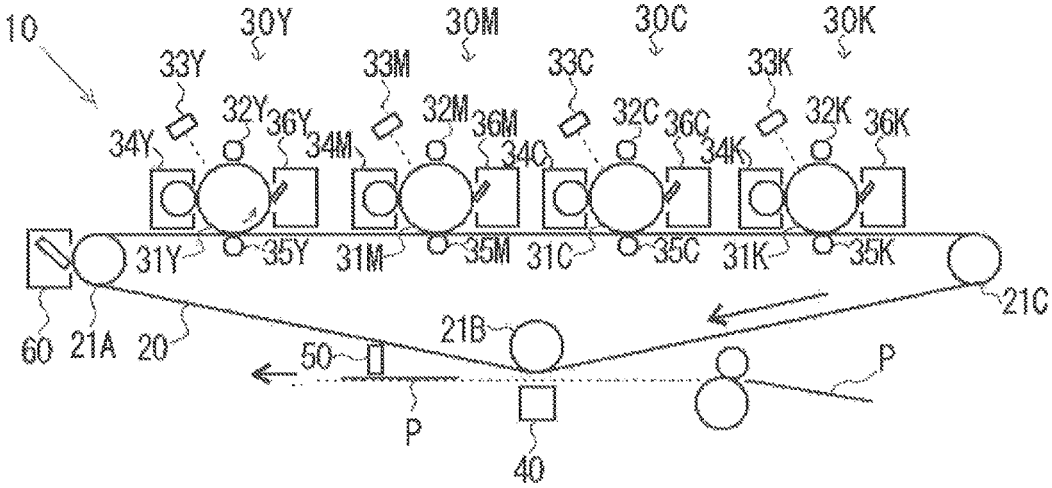

FIXING SOLUTION AND IMAGE FORMING METHOD

CROSS-REFERENCE TO RELATED APPLICATIONS

This application is a divisional of U.S. application Ser. No. 13/852,802 filed Mar. 28, 2013 which claimed the priority of Japanese Patent Application No. 2012-084517 filed on Apr. 3, 2012, the contents of each of which are incorporated herein by reference.

BACKGROUND OF THE INVENTION

Field of the Invention

The present invention relates to a fixing solution used in an image forming method of a wet fixing system using an electrophotography and an image forming method using this fixing solution.

Description of the Related Art

An image forming device such as a printer, a facsimile machine or a copying machine is a device that forms an image including characters and symbols on an image support such as paper, cloth or an OHP sheet based on image information.

In particular, the image forming devices of the electrophotography are widely utilized in, for example, offices or the like, because it is possible to form a high minute image on a plain paper at high speed. In the image forming device of the electrophotography described above, there is widely used a thermal fixing system in which the toner constituting a toner image on an image support is heated and melted, the molten toner is pressurized, and thus the toner image is fixed on the image support. With such a thermal fixing system, it is possible to provide a high fixing rate and a high image quality.

However, in the image forming device of the thermal fixing system described above, about half or more of consumption power is consumed to heat the toner. In contrast, from the viewpoint of measures against environmental issues in recent years, there has been desired a fixing method in which lower power consumption (energy saving) is ensured. That is, it is desirable to use a fixing method in which the temperature at which the toner is heated to be fixed is extremely lowered compared with in the past or in which heating of the toner is not necessary. In particular, a non-heating fixing system in which a toner image is fixed on an image support without a toner being heated is ideal in terms of low power consumption.

As the non-heating fixing system, a wet fixing system is known in which a fixing solution for softening a toner is supplied to a toner image to thereby fix it on an image support. However, there are a few problems in the wet fixing system.

For example, a problem exists in which, when in order for a high fixing strength to be obtained, a large amount of fixing solution is coated on an image support such as paper, the toner particles constituting a toner image are moved on the image support by the excessive amount of fixing solution to thereby degrade the image quality, and a problem exists in which drying time is elongated, which degrades the fixing responsiveness (see Patent Literatures 1 and 2). Furthermore, a problem exists in which a remarkable feeling of liquid left in paper (a wet feeling when paper is touched with a hand) is produced.

Moreover, for example, when, as a fixing solution, an oil droplet water solution-type fixing solution is used in which an organic compound insoluble or poorly soluble in water is dispersed and mixed with water, if a large amount of fixing solution is supplied, an image support such as paper absorbs water in the fixing solution, and thus a crease or a curl is generated on the image support. This causes a problem of reducing the stable and high-speed transport properties of the image support which is required in the image forming device (see Patent Literature 3).

As to the fixing responsiveness, when the rate at which the fixing solution is softened for the toner is low, it is necessary to set the image processing rate of the image forming device to low, and thus there is a problem in which an image processing capacity that the image forming device originally has cannot be achieved. In particular, when image formation using a color toner is performed, toner particles of different colors are stacked to increase the thickness, and thus it is necessary to use a fixing solution having a high softening rate with respect to the toner (see Patent Literature 4).

As described above, in the fixing solution used in the wet fixing system, faster fixing rate and faster drying rate are required to be achieved while the supply amount of fixing solution is reduced and excellent fixing performances such as reducing a wet feeling in a formed image and having a high fixing strength are required.

CITATION LIST

Patent Literature

[Patent Literature 1] Japanese Patent No. 4302700
[Patent Literature 2] Japanese Patent No. 4358896
[Patent Literature 3] Japanese Patent No. 3290513
[Patent Literature 4] Japanese Patent Application Laid-Open No. 2011-128457

SUMMARY OF THE INVENTION

Technical Problems

The present invention has been made on the basis of the forgoing conditions, and an object of the present invention is to provide a fixing solution and an image forming method in which faster fixing rate and faster drying rate are achieved while the supply amount of fixing solution is reduced and in which a wet feeling is reduced in a formed image and an image having a high fixing strength can be formed.

Means to Solve the Problems

To achieve abovementioned object, there is provided, reflecting one aspect of the present invention, a fixing solution that softens a toner to fix a toner image constituted by the toner on an image support, in which the fixing solution contains a hydroxyl group-containing ester compound expressed by general formula (1) below:

$$R^1\text{—(CO)—O—}R^2, \qquad \text{general formula (1):}$$

where $R^1$ represents a linear or branched alkyl group having 6 to 11 carbon atoms, and $R^2$ represents a linear or branched alkyl group having at least one hydroxyl group and 2 to 4 carbon atoms.

In the fixing solution of the present invention, in the general formula (1), $R^1$ is preferably a linear or branched alkyl group having 6 to 9 carbon atoms.

In the fixing solution of the present invention, in the hydroxyl group-containing ester compound expressed by the general formula (1), it is preferable that $R^2$ in the general formula (1) has one hydroxyl group, and the hydroxyl group is in a β position with respect to an oxycarbonyl group. In particular, the hydroxyl group-containing ester compound expressed by the general formula (1) is preferably hydroxypropyl caprylate.

The fixing solution of the present invention further preferably contains water and a surfactant. The surfactant is at least one selected from a group consisting of: sodium laurate, sodium myristate, sodium oleate, sodium dodecyl benzene sulfonate, sodium lauryl sulfate, sodium polyethoxyethylene lauryl ether sulfate, sodium polyoxyethylene nonylphenyl ether sulfate, sodium monooctyl sulfosuccinate, sodium dioctyl sulfosuccinate, sodium polyoxyethylene lauryl sulfosuccinate, benzethonium chloride, polyoxyethylene lauryl ether, polyoxyethylene stearyl ether, polyoxyethylene nonylphenyl ether, sorbitan monolaurate, sorbitan monostearate, sorbitan trioleate, polyoxyethylene sorbitan monolaurate, polyoxyethylene monolaurate, polyoxyethylene monostearate, oleate monoglyceride and stearic acid monoglyceride.

Moreover, in the fixing solution of the present invention, the surfactant in the fixing solution is preferably contained at a rate of 1 to 5% by mass.

An image forming method of the present invention includes: an electrostatic latent image formation step of forming an electrostatic latent image on an electrostatic latent image carrier; a development step of forming a toner image by developing the electrostatic latent image with a dry developer including the toner; a transfer step of transferring the toner image to an image support; and a fixing solution supply step of supplying a fixing solution to the toner image transferred to the image support, in which the above-mentioned fixing solution is used as the fixing solution.

Furthermore, in the image forming method of the present invention, in the fixing solution supply step, a line-type inkjet nozzle is preferably used to supply the fixing solution with a liquid droplet size ranging from 0.5 to 50 pl.

Moreover, in the image forming method of the present invention, a binder resin constituting the toner is preferably a styrene-(meth) acrylic resin.

Effects of the Invention

According to the fixing solution of the present invention, the hydroxyl group-containing ester compound (hereinafter, also referred to as a "specific hydroxyl group containing ester compound") expressed by general formula (1) is contained, and thus faster fixing rate and faster drying rate are realized while the amount of fixing solution supplied is reduced and furthermore, a wet feeling in a formed image is reduced and a high fixing strength is obtained.

Moreover, according to the image forming method of the present invention, in a wet fixing system, the fixing solution of the present invention is used, and thus faster fixing rate and faster drying rate are realized while the amount of fixing solution supplied is reduced and furthermore, a wet feeling in a formed image is reduced and an image having a high fixing strength can be formed.

BRIEF DESCRIPTION OF THE DRAWINGS

FIG. 1 is an illustrative cross-sectional view showing an example of the configuration of fixing solution supply means used when the fixing solution of the present invention is supplied;

FIG. 2 is an illustrative cross-sectional view showing an example of the configuration of the fixing solution supply means and pressure application means used when the fixing solution of the present invention is supplied;

FIG. 3 is an illustrative cross-sectional view showing another example of the configuration of the fixing solution supply means used when the fixing solution of the present invention is supplied;

FIG. 4 is an illustrative cross-sectional view showing yet another example of the configuration of the fixing solution supply means used when the fixing solution of the present invention is supplied;

FIG. 5 is an illustrative cross-sectional view showing still another example of the configuration of the fixing solution supply means used when the fixing solution of the present invention is supplied; and FIG. 6 is a schematic diagram showing an example of the configuration of an image forming device used in the image forming method of the present invention.

DESCRIPTION OF THE EMBODIMENTS

Hereinafter, the present invention will be described in detail.

[Fixing Solution]

The fixing solution of the present invention is a fixing solution which is used in an image forming method of a wet fixing system and in which, by softening of a toner, a toner image constituted by the toner is fixed onto an image support and which contains a specific hydroxyl group-containing ester compound as a softening agent.

The fixing solution of the present invention may contain, as necessary, other components such as a diluent such as water and a dispersing agent such as a surfactant.

[Hydroxyl Group Containing Ester Compound Expressed by General Formula (1)]

A hydroxyl group containing ester compound constituting the fixing solution of the present invention and that is expressed by general formula (1) acts as a softening agent that dissolves or swells and then softens at least a part of a binder resin (hereinafter also referred to as a "toner resin") constituting a toner.

By, in the fixing solution of the present invention, the specific hydroxyl group-containing ester compound being contained, when the fixing solution is supplied to the toner image, it is considered that an ester bond (group) within the molecule of the specific hydroxyl group-containing ester compound and the molecule of a toner resin are intermolecularly hydrogen-bonded to each other, to thereby have an affinity and soften the toner, and a hydroxyl group within the molecule of the specific hydroxyl group-containing ester compound and the resin molecule are also intermolecularly hydrogen-bonded to each other, to thereby facilitate the softening of the toner. Moreover, it is considered that the toner that are softened as a result of the hydroxyl group within the molecule of the specific hydroxyl group-containing ester compound being intermolecularly hydrogen-bonded to the molecule of the fiber cellulose of the image support such as paper are adsorbed to paper fiber, and thus a high adhesion can be obtained. That is, since it is considered that these hydrogen bonds produce effects on the "softening of the toner" and "affinity for paper (adhesion)," in the fixing solution according to the present invention, faster fixing rate and faster drying rate are realized while the supply amount of fixing solution being reduced, and also a wet feeling is reduced in a formed image and a high fixing strength is achieved. Note that the mechanism of the softening of the toner with the hydroxyl group is considered to be the same as the mechanism (solvation) of the dissolving the toner resin with, for example, a low molecular alcohol and THF (tetrahydrofuran).

In addition, after the softening of the toner, through the hydrogen bond of the hydroxyl group within the resin molecule, it is possible to enhance the elasticity of the image as a whole and suppress a tack feeling (wet feeling).

In general formula (1), $R^1$ represents a linear or branched alkyl group having 6 to 11 carbon atoms. In $R^1$, the number of carbon atoms is particularly preferably 6 to 9 from the viewpoint of the fixing property.

When $R^1$ has five or more carbon atoms, an odor is likely to be emitted. In contrast, when $R^1$ has twelve or more carbon atoms, it is likely that a high fixing strength cannot be obtained.

$R^2$ represents a linear or branched alkyl group having at least one hydroxyl group and 2 to 4 carbon atoms. In $R^2$, the number of carbon atoms is particularly preferably three from the viewpoint of the fixing property.

When $R^2$ has five or more carbon atoms, it is likely that that a high fixing strength cannot be obtained.

Both $R^1$ and $R^2$ are preferably a linear alkyl group from the viewpoint of permeability into the toner resin.

Specific examples of the hydroxyl group-containing ester compound represented by general formula (1) include hydroxypropyl caprylate, lauric acid hydroxypropyl, enanthic acid hydroxypropyl, and the like. The specific hydroxyl group-containing ester compound can be used alone or a combination of two or more of them.

Preferably, in the present invention, the specific hydroxyl group-containing ester compound has, in $R^2$ of general formula (1), one hydroxyl group, and the hydroxyl group in the β position with respect to an oxycarbonyl group. Specific examples thereof include caprylic acid 2-hydroxypropyl, lauric acid 2-hydroxypropyl, enanthic acid 2-hydroxypropyl, and the like. Since, by the hydroxyl group being positioned in the β position with respect to the oxycarbonyl group, the oxycarbonyl group and the hydroxyl group are more likely to be on the same side (the same plane) in terms of molecular backbone (configuration), a large number of hydrogen bonds formed with the toner or the fiber cellulose per molecule of the hydroxyl group containing ester compound represented by general formula (1) are considered to be ensured. This is not limited to the β position but it is considered that there is exhibited a similar tendency with respect to the σ position. In contrast, since, by the hydroxyl group being positioned in the α position, the carbonyl group and the hydroxyl group are more likely to be positioned facing each other, the number of hydrogen bonds formed with the toner or the fiber cellulose is considered to be decreased as compared with the β position. As described above, preferably, the structure in which the hydroxyl group is positioned in the β position is considered to have higher affinity with the fixing solution, the toner and the image support.

The specific hydroxyl group-containing ester compound is preferably contained at a rate of 1 to 30% by mass relative to the fixing solution, and more preferably 5 to 20% by mass.

The specific hydroxyl group-containing ester compound content falls within the range mentioned above, and thus a high affinity for the toner resin can be obtained, a high fixing strength and a high fixing rate can be obtained, and a wet feeling of the obtained image is suppressed.

When the specific hydroxyl group-containing ester compound content is less than 1% by mass, a high affinity for the toner resin cannot be obtained, and the fixing strength and the fixing rate may be decreased. In contrast, when the specific hydroxyl group-containing ester compound content is more than 30% by mass, a wet feeling of the obtained image remains and this may adversely affect the drying rate and the wet feeling of the obtained image.

(Diluent)

The fixing solution of the present invention may contain a diluent that dilutes and disperses the specific hydroxyl group-containing ester compound. As the diluent, an example thereof is water, and specifically, ion exchange water. Furthermore, a solvent that can dissolve the specific hydroxyl group-containing ester compound, specifically, isoparaffin, silicone oil or the like can be used.

The diluent in the fixing solution is preferably contained at a rate of 50 to 90% by mass relative to the fixing solution, and more preferably 80 to 90% by mass.

(Dispersing Agent) In the fixing solution of the present invention, as necessary, the dispersing agent may be contained as an agent for enhancing the solubility and dispersibility of the specific hydroxyl group-containing ester compound in the diluent agent.

Examples of the dispersing agent include surfactants, specifically, an anionic surfactant, a cationic surfactant, a nonionic surfactant and the like.

Examples of the anionic surfactant include, as the surfactant: higher fatty acid salts such as sodium laurate, sodium myristate and sodium oleate; alkyl aryl sulfonic acid salts such as sodium dodecyl benzene sulfonate; alkyl sulfate ester salts such as sodium lauryl sulfate; polyoxyethylene alkyl ether sulfate ester salts such as polyethoxylene ethylene sodium lauryl ether sulfate; polyoxyethylene alkyl aryl ether sulfuric acid ester salts such as polyoxyethylene nonylphenyl ether sodium sulfate; alkyl sulfosuccinate ester salts such as monooctyl sulfosuccinate sodium sulfosuccinate, sodium dioctyl sulfosuccinate, and sodium polyoxyethylene lauryl sulfosuccinate; and their derivatives. Examples of the cationic surfactant include aliphatic amine salt, aliphatic quaternary ammonium salt, benzalkonium salt, benzethonium chloride, a pyridinium salt, an imidazolinium salt and the like.

Examples of the nonionic surfactant include: polyoxyethylene alkyl ethers such as polyoxyethylene lauryl ether and polyoxyethylene stearyl ether; polyoxyethylene alkyl phenyl ethers such as polyoxyethylene nonylphenyl ether; sorbitan higher fatty acid esters such as sorbitan monolaurate, sorbitan monostearate and sorbitan trioleate; polyoxyethylene sorbitan higher fatty acid esters such as polyoxyethylene sorbitan monolaurate; polyoxyethylene higher fatty acid esters such as polyoxyethylene monolaurate and polyoxyethylene monostearate; glycerol higher fatty acid esters such as oleate monoglyceride and stearic acid monoglyceride; polyoxyethylene-polyoxypropylene block copolymer and sucrose esters such as sucrose lauric acid ester and sucrose stearic acid ester.

The dispersing agent in the fixing solution is preferably contained at a rate of zero to 10% by mass, and more preferably 1 to 5% by mass.

[Amount of Fixing Solution Supplied]

The amount of fixing solution supplied of the present invention is preferably 0.4 g or less per, A4-size image support, and is more preferably 0.1 g or less.

(Method of Manufacturing the Fixing Solution)

An example of a method of manufacturing the fixing solution of the present invention is a method of sequentially putting the specific hydroxyl group-containing ester compound and the dispersing agent, as necessary, in a fixing solution supply tank, thereafter putting the diluent and using an ultrasonic homogenizer to agitate them at room temperature for five minutes. Therefore, it is possible to prepare the fixing solution in which the diameter of dispersed particles of the specific hydroxyl group-containing ester compound is 150 to 250 μm.

[Method of Supplying the Fixing Solution]

An example of a method of supplying the fixing solution of the present invention is a method of, through the use of fixing solution supply means, for example, injecting, spraying or coating the fixing solution in the form of a liquid or a foam.

Examples of the fixing solution supply means include, for example, an inkjet nozzle, a spray using an ultrasonic vibrator, a spray using a compressed air, a spray that forms liquid droplets electrostatically, a roller, and the like.

Hereinafter, the method of supplying the fixing solution of the present invention will be specifically described.

FIG. 1 is an illustrative cross-sectional view showing an example of the configuration of the fixing solution supply means used when the fixing solution of the present invention is supplied.

This fixing solution supply means 50A is formed with a line-type inkjet nozzle, and is arranged on the downstream side of a toner image carrier 31.

In the fixing solution supply means 50A as described above, the fixing solution F formed into liquid droplets is supplied to the toner image T in accordance with the region of the toner image T transferred onto the image support P.

In the line-type inkjet constituting the fixing solution supply means 50A as described above, its resolution is preferably 300 dpi or more. In addition, the size of the liquid droplet of the inkjet is preferably 0.5 to 50 pl.

Note that, when the inkjet nozzle is used as the fixing solution supply means 50A, the fixing solution needs to have solvent resistance.

Furthermore, when the fixing solution is not liquid at room temperature or more, or when the fixing solution has a high viscosity, a heater can be provided in the fixing solution supply means 50A.

Moreover, after the supply of the fixing solution, a step of applying a pressure to the toner image T to which the fixing solution F has been supplied is performed, that is, the fixing solution supply step is preferably accompanied by a pressure application step, which will be described later. Specifically, as shown in FIG. 2, after the supply of the fixing solution, pressure application means 70 formed with a pair of pressuring rollers can apply a pressure to the toner image T to which the fixing solution F has been supplied.

As the pressure application means, for example, rollers having separable surfaces or the like can also be used. The applied pressure is not particularly limited, and it is preferably, for example, 50 kPa to 1 MPa.

The pressure application step described above is performed, and thus it is possible to obtain a high fixing strength in the formed image.

FIG. 3 is an illustrative cross-sectional view showing another example of the configuration of the fixing solution supply means used when the fixing solution of the present invention is supplied.

This fixing solution supply means 50B is constituted by a fixing solution coating roller 51 and a pressurizing roller 52 provided facing this fixing solution coating roller 51. A portion of this fixing solution coating roller 51 is immersed in, for example, the liquid fixing solution F. In addition, a metalling blade 53 controlling the amount of fixing solution F which needs to be supplied onto the toner image T is provided in a state where its end portion is separated from the surface of the fixing solution coating roller 51.

In the fixing solution supply means 50B as described above, by the rotational drive of the fixing solution coating roller 51 and the pressurizing roller 52, there is regulated, by the metalling blade 53, the amount of liquid fixing solution F supplied on the fixing solution coating roller 51, and thus the fixing solution F is supplied, as a liquid film M, to the entire surface of the image support P to which the toner image T has been transferred and a pressure is applied by the pressurizing roller 52.

The thickness of the liquid film M is not particularly limited, and it is preferably, for example, 1 to 100 μm.

In addition, the pressure applied by the pressurizing roller 52 is preferably, for example, 150 kPa to 250 kPa.

FIG. 4 is an illustrative cross-sectional view showing yet another example of the configuration of the fixing solution supply means used when the fixing solution of the present invention is supplied.

This fixing solution supply means 50C is constituted by a foam generation device 54 that sprays, in the form of a foam, the fixing solution, a fixing solution coating roller 55 and a pressurizing roller 56 provided facing the fixing solution coating roller 55. Moreover, a regulation blade 57 controlling the amount of fixing solution F that needs to be supplied onto the toner image T is provided in a state where its end portion is separated from the surface of the fixing solution coating roller 55.

In the fixing solution supply means 50C described above, by the rotational drive of the fixing solution coating roller 55 and the pressurizing roller 56, there is regulated, by the regulation blade 57, the amount of foamed fixing solution F supplied on the fixing solution coating roller 55, and thus the fixing solution F is supplied, as a foamed film B, to the entire surface of the image support P to which the toner image T has been transferred and a pressure is applied by the pressurizing roller 56.

The thickness of the foamed film B is not particularly limited, and it is preferably, for example, 50 to 80 μm.

Furthermore, the pressure applied by the pressurizing roller 56 is preferably, for example, 150 kPa to 250 kPa.

FIG. 5 is an illustrative cross-sectional view showing still another example of the configuration of the fixing solution supply means used when the fixing solution of the present invention is supplied.

This fixing solution supply means 50D is formed with a spray using a compressed air, and is arranged on the downstream side of the toner image carrier 31.

In the fixing solution supply means 50D as described above, the liquid fixing solution F is sprayed and is supplied to the toner image T transferred onto the image support P.

According to the fixing solution of the present invention, by the fixing solution containing the specific hydroxyl group-containing ester compound, faster fixing rate and faster drying rate are realized while the amount of fixing solution supplied is reduced, and furthermore, a wet feeling is reduced on the formed image and a high fixing strength is obtained.

<Image Forming Method>

The image forming method of the present invention includes at least an electrostatic latent image formation step of forming an electrostatic latent image on an electrostatic latent image carrier, a development step of forming a toner image by developing the electrostatic latent image with a dry developer including a toner containing at least a binder resin, a transfer step of transferring the toner image to the image support and a fixing solution supply step of supplying the fixing solution to the toner image transferred to the image support, and as the fixing solution, the fixing solution of the present invention is used.

[Electrostatic Latent Image Formation Step]

The electrostatic latent image formation step is a step of forming the electrostatic latent image on the electrostatic latent image carrier.

Although electrostatic latent image carrier is not particularly limited, examples thereof include drum-shaped electrostatic latent image carriers formed of inorganic photoreceptors such as amorphous silicon and serene, and organic photoreceptors such polysilane and phthalopolymethin.

The formation of the electrostatic latent image is performed by, for example, uniformly charging the surface of the electrostatic latent image carrier with charging means and exposing, as an image, the surface of the electrostatic latent image carrier with exposure means.

The charging means and the exposure means are not particularly limited, and means commonly used in an electrophotographic system can be used.

[Development Step]

The development step is a step of forming a toner image by developing the electrostatic latent image with a dry developer including the toner.

The formation of the toner image is performed by, for example, a development means having an agitator that frictionally agitates to charge the toner and a rotatable magnetic roller, using the dry developer including the toner. Specifically, in the development means, for example, the toner and a carrier are mixed and agitated, a friction caused at that time allows the toner to be charged, the toner is retained on the surface of the rotating magnetic roller, and a magnetic brush is formed. Since the magnetic roller is arranged near the electrostatic latent image carrier, a part of the toner constituting the magnetic brush formed on the surface of the magnetic roller is moved to the electrostatic latent image carrier by an electrical suction force. Consequently, the electrostatic latent image is developed with the toner and the toner image is formed on the surface of the electrostatic latent image carrier.

[Toner]

The toner used in the image forming method of the present invention includes toner particles containing at least a binder resin. The toner particles may contain, as necessary, internal additives such as a coloring agent, a releasing agent, a magnetic powder and a charge control agent, and external additives such as a fluidizer may be externally added to the toner particles.

The particles of the toner used in the image forming method of the present invention have a volume-based median diameter of preferably 3.5 to 7.0 μm, and more preferably 5.0 to 6.5 μm.

The volume-based median diameter in the toner falls within the range mentioned above, and thus the specific surface area of the toner is sufficiently ensured. Therefore, since, in the fixing solution supply step described later, the contact area with the fixing solution is sufficiently ensured, it is possible to reliably fix the toner image on the image support, and thus the sufficient fixing strength can be obtained in a formed image.

When the volume-based median diameter of the toner is less than 3.5 μm, the formed image may be rough. In contrast, when the volume-based median diameter of the toner is more than 7.0 μm, the specific surface area of the toner is low, the contact area with the fixing solution is insufficiently ensured in the fixing solution supply step described later, and it is likely that the toner image cannot be reliably fixed on the image support.

In the present invention, the volume-based median diameter of the toner is measured and calculated through the use of a measurement device in which a computer system equipped with a data processing software program "Software V3.51" is connected to "Coulter Multisizer 3" (manufactured by Beckman Coulter, Inc.).

Specifically, 0.02 g of a specimen (toner) is added and soaked in 20 mL of a surfactant solution (for example, a surfactant solution obtained by diluting, by a factor of 10, with pure water, a neutral detergent containing a surfactant component in order to disperse the toner particles), thereafter ultrasonic dispersion is performed for one minute to prepare the dispersion solution and the dispersion solution is poured with a pipette into a beaker containing "ISOTONII" (manufactured by Beckman Coulter, Inc.) within a sample stand until a concentration displayed on the measurement device becomes 8%.

Here, by setting this concentration range described above, it is possible to obtain a reproducible measurement value. Then, in the measurement device, a frequency value is calculated by setting the count number of particles measured to 25000, setting the aperture diameter to 50 μm, dividing the measurement range of 1 to 30 μm into 256 parts, and the size of particles having 50% diameter in descending order in volume-based cumulative fractions is set to the volume-based median diameter.

The average degree of circularity of the toner used in the image forming method of the present invention is preferably 0.930 to 1.000 from the viewpoint of improving transfer efficiency, and is more preferably 0.950 to 0.995.

In the present invention, the average degree of circularity of the toner is measured through the use of "FPIA-2100" (manufactured by Sysmex Corporation).

Specifically, the specimen (toner) is soaked in a surfactant-containing aqueous solution, is subjected to ultrasonic dispersion treatment for one minute to disperse the specimen, thereafter shooting is performed with the "FPIA-2100" (manufactured by Sysmex Corporation) in a measurement condition HPF (high magnification shooting) mode in an appropriate concentration of a HPF detection number of 3,000 to 10,000, the degree of circularity of each toner particle is calculated in accordance with the following formula (T), the degrees of circularity of the individual toner particles are added and it is divided by the number of all toner particles, with the result that the average degree of circularity is calculated.

circularity=(circumferential length of a circle having the same projection area as a particle image)/(circumferential length of an image of a particle) Formula (T):

The glass transition temperature of the toner used in the image forming method of the present invention is preferably 30 to 70° C. from the viewpoint of heat-resistant storage and blocking resistance, and is more preferably 35 to 50° C.

In the present invention, the glass transition temperature of the toner is measured through the use of a differential scanning calorimeter "DSC8500" (manufactured by PerkinElmer Co., Ltd.).

Specifically, 4.5 mg of the specimen (toner) is accurately weighed with a balance to two places of decimals, is sealed in an aluminum pan, and is set in a sample holder DSC-7. As the reference, an empty aluminum pan is used, Heat-Cool-Heat temperature control is performed under the conditions of a measurement temperature of 0 to 200° C., a temperature rise rate of 10° C./minute and a temperature drop rate of 10°

C./minute, and analysis is performed on the basis of data in the second heat. The value of an intersection between the extension line of a baseline before the rise of the first endothermic peak and a tangent indicating the maximum gradient between the rise part of the first endothermic peak and the peak vertex is defined as the glass transition temperature.

The softening temperature of the toner used in the image forming method of the present invention is preferably 90 to 120° C. from the viewpoint of the fixing strength, and is more preferably 100 to 115° C.

In the present invention, the softening temperature of the toner is measured as follows.

Specifically, under the circumstances of a temperature of 20±1° C. and humidity of 50±5% RH, 1.1 g of the specimen (toner) is put in a petri dish and is flattened, and is left for twelve or more hours, is thereafter pressurized by a force of 3820 kg/cm$^2$ for 30 seconds with a molding machine "SSP-10A" (manufactured by Shimadzu Corporation) into a cylindrical molded sample having a diameter of 1 cm; then, this molded sample is extruded at the time of the completion of preheating, through a cylindrical die hole (1 mm diameter×1 mm) with a piston having a diameter of 1 cm, under the circumstances of a temperature of 24±5° C. and humidity of 50±20% RB, and under the conditions of a load of 196 N (20 kgf), a start temperature of 60° C., a preheat time of 300 seconds and a temperature rise rate of 6° C./minute through the use of a flow tester "CFT-500D" (manufactured by Shimadzu Corporation), and an offset temperature $T_{offset}$ is measured at a setting of an offset value of 5 mm, as the softening temperature, in a melting temperature measurement method that is a temperature rise method.

(Binder Resin)

Examples of the binder resin in the toner used in the image forming method of the present invention include various known resins such as styrene resin, (meth)acrylic resin, styrene-(meth) acrylic resin, polyester resin, polyether polyol resin and polyvinyl acetate resin. Among them, from the viewpoint of affinity with the softening agent, styrene resin, styrene-(meth) acrylic resin, and polyester resin are preferable.

When, as the binder resin, styrene resin, (meth)acrylic resin or styrene-(meth) acrylic resin is used, examples of a polymerizable monomer forming the binder resin include vinyl monomers such as: styrene and styrene derivatives such as o-methyl styrene, m-methyl styrene, p-methyl styrene, α-methyl styrene, p-phenyl styrene, p-ethyl styrene, 2,4-dimethyl styrene, p-tert-butyl styrene, p-n-hexyl styrene, p-n-octyl styrene, p-n-nonyl styrene, p-n-decyl styrene and p-n-dodecyl styrene; methacrylic acid ester derivatives such as methyl methacrylate, ethyl methacrylate, n-butyl methacrylate, isopropyl methacrylate, isobutyl methacrylate, t-butyl methacrylate, n-octyl methacrylate, methacrylic acid-2-ethylhexyl, stearyl methacrylate, lauryl methacrylate, phenyl methacrylate, diethylaminoethyl methacrylate and dimethylaminoethyl methacrylate; acrylic acid ester derivatives such as methyl acrylate, ethyl acrylate, isopropyl acrylate, n-butyl acrylate, t-butyl acrylate, isobutyl acrylate, n-octyl acrylate, acrylic acid-2-ethylhexyl and phenyl acrylate: olefins such as ethylene, propylene and isobutylene; and acrylic acid or methacrylic acid derivatives such as acrylonitrile, methacrylonitrile and acrylamide. These vinyl monomers can be used alone or in combination of two or more of them.

Furthermore, as the polymerizable monomer that forms the binder resin, a combination of the polymerizable monomer described above and a polymerizable monomer having an ionic dissociable group is preferably used. The polymerizable monomer having an ionic dissociable group has, as a constituent group, a substituent group such as a carboxyl group, a sulfonic acid group or a phosphoric acid group. Specific examples include acrylic acid, methacrylic acid, maleic acid, itaconic acid, cinnamic acid, fumaric acid, monoalkyl ester maleate, monoalkyl ester itaconic acid, styrene sulfonic acid, allyl sulfonate succinic acid, 2-acrylamido-2-methylpropane sulfonic acid and the like.

Furthermore, as the polymerizable monomer, there is used a polyfunctional vinyl such as divinylbenzene, ethylene glycol dimethacrylate, ethylene glycol diacrylate, diethylene glycol dimethacrylate, diethylene glycol diacrylate, triethylene glycol dimethacrylate, triethylene glycol diacrylate, neopentyl glycol dimethacrylate, neopentyl glycol diacrylate or the like, and thus it is also possible to obtain a cross-linked binder resin.

When, as the binder resin, polyester resin is used, polyester resin can be obtained by a known polyhydric alcohol and a known polycarboxylic acid.

Examples of the polyhydric alcohol include: aliphatic diols such as ethylene glycol, 1,3-propanediol, 1,4-butanediol, 1,5-pentanediol, 1,6-hexanediol, 1,7-heptane diol, 1,8-octanediol, 1,9-nonanediol, 1,10-decane diol, 1,11-undecane diol, 1,12-dodecanediol, 1,13-tri-decanediol, 1,14-tetra-decane diol, 1,18-octadecane diol and 1,20-eicosanic diol; bisphenols such as bisphenol A and bisphenol F; and alkylene oxide adducts of bisphenols such as a ethylene oxide adduct and propylene oxide adduct. Examples of trivalent or more polyhydric alcohols include glycerol, pentaerythritol, trimethylolpropane and sorbitol. Examples of polyhydric alcohols having an unsaturated group include: polyhydric alcohols having an unsaturated double bond such as 2-butene-1,4-diol, 3-butene-1,6-diol, 4-butene-1,8-diol and 9-octadecene-7,12-diol; and polyhydric alcohols having an unsaturated triple bond such as 2-butyne-1,4-diol and 3-butyne-1,4-diol. Among these polyhydric alcohols, only one or a combination of two or more can be used.

Examples of the polycarboxylic acid include: aliphatic carboxylic acids such as oxalic acid, malonic acid, succinic acid, glutaric acid, adipic acid, pimelic acid, suberic acid, azerin acid, sebacic acid, 1,9-nonanedicarboxylic acid, 1,10-decanedicarboxylic acid, 1,11-undecanedicarboxylic acid, 1,12-dodecane dicarboxylic acid, 1,13-tridecanedicarboxylic acid, 1,14-tetradecanedicarboxylic acid, 1,16-hexadecanedicarboxylic acid and 1,18-oxtadecanedicarboxylic acid; lower alkyl esters and anhydrides of these aliphatic carboxylic acids; aromatic carboxylic acids such as phthalic acid, isophthalic acid, terephthalic acid, ozthophthalic acid, t-butyl isophthalic acid, 2,6-naphthalene dicarboxylic acid and 4,4'-biphenyl dicarboxylic acid; and trivalent or more polycarboxylic acids such as trimellitic acid and pyromellitic acid. Examples of the polycarboxylic acid having an unsaturated group include: unsaturated aliphatic carboxylic acids such as maleic acid, fumaric acid, itaconic acid, citraconic acid, glutaconic acid, isodecenyl succinic acid, n-dodecenyl succinic acid and n-octenyl succinic acid; anhydrides or acid chlorides of these acids; and unsaturated aromatic carboxylic acids such as caffeic acid. Among these polycarboxylic acids, only one or a combination of two or more can be used.

The polyester resin can be manufactured by, for example, the condensation polymerization of the polyhydric alcohol and the polycarboxylic acid described above in an atmosphere of an inert gas at a temperature of 120 to 250° C. At the time of the condensation polymerization, a known esterification catalyst may be used as necessary.

The glass transition temperature of the binder resin is preferably 20 to 90° C. and is more preferably 35 to 45° C.

When the glass transition temperature of the binder resin is less than 20° C., satisfactory heat-resistant storage may not be obtained.

In the present invention, the glass transition temperature of the binder resin is measured in the same way as the way in which the glass transition temperature of the toner described above is measured, except that the specimen is replaced with the binder resin.

The weight-average molecular weight of the binder resin is preferably 3,000 to 100,000 and is more preferably 5,000 to 50,000.

When the weight-average molecular weight of the binder resin is less than 3,000, the strength of the toner particles is decreased, and the toner scattering is caused. In contrast, when the weight-average molecular weight of the binder resin is more than 100,000, a high fixing strength of a formed image may not be obtained.

In the present invention, the weight-average molecular weight of the binder resin is measured with a GPC.

Specifically, a device "HLC-8220" (manufactured by Tosoh Corporation) and a column "TSK guard column+TSK gel Super HZM-M3 series" (manufactured by Tosoh Corporation) are used, tetrahydrofuran (THF) is caused to flow as a carrier solvent at a flow rate of 0.2 mL/minute while the column temperature is maintained at 40° C., the specimen (binder resin) is dissolved in THF under dissolving conditions in which the processing is performed with an ultrasonic disperser at room temperature for 5 minutes such that its concentration is 1 mg/mL, then processing is performed with a membrane filter having a pore size of 0.2 μm to obtain a specimen solution, 10 μL of the specimen solution is poured into the device together with the carrier solvent, detection is performed with a refractive index detector (RI detector) and the molecular weight distribution of the specimen is calculated with a standard curve measured using monodispersed polystyrene standard particles. Ten items of polystyrene for the standard curve measurement are used.

(Coloring Agent)

In the toner used in the image forming method of the present invention, a coloring agent is not particularly limited, and a known coloring agent can be used.

Examples of a black coloring agent include carbon blacks such as a furnace black, a channel black, an acetylene black, a thermal black and a lamp black.

Examples of a magenta or red coloring agent include C. I. pigment red 2, C. I. pigment red 3, C. I. pigment red 5, C. I. pigment red 6, C. I. pigment red 7, C. I. pigment red 15, C. I. pigment red 16, C. I. pigment red 48; 1, C. I. pigment red 53; 1, C. I. pigment red 57; 1, C. I. pigment red 122, C. I. pigment red 123, C. I. pigment red 139, C. I. pigment red 144, C. I. pigment red 149, C. I. pigment red 166, C. I. pigment red 177, C. I. pigment red 178, C. I. pigment red 222 and the like.

Examples of an orange or yellow coloring agent include C. I. pigment orange 31, C. I. pigment orange 43, C. I. pigment yellow 12, C. I. pigment yellow 13, C. I. pigment yellow 14, C. I. pigment yellow 15, C. I. pigment yellow 74, C. I. pigment yellow 93, C. I. pigment yellow 94, C. I. pigment yellow 138, C. I. pigment yellow 100, C. I. pigment yellow 104 and the like.

Examples of a green or cyan coloring agent include C. I. pigment blue 15, C. I. pigment blue 15; 2, C. I. pigment blue 15; 3, C. I. pigment blue 15; 4, C. I. pigment blue 16, C. I. pigment blue 60, C. I. pigment blue 62, C. I. pigment blue 66, C. I. pigment green 7 and the like.

These coloring agents can be used alone or in combination of two or more of them.

The content rate of a coloring agent is preferably 1 to 10 parts by mass relative to 100 parts by mass of the binder resin, and is more preferably 2 to 9 parts by mass.

(Releasing Agent)

In the toner used in the image forming method of the present invention, an example of the releasing agent is a wax.

Specifically, examples thereof include:

(1) Polyolefin-based waxes

Polyethylene wax, polypropylene wax and the like (2) Long-chain hydrocarbon waxes Paraffin wax, sasol wax and the like (3) Dialkyl ketone-based waxes Distearyl ketone wax and the like (4) Ester-based waxes Carnauba wax, montan wax, trimethylolpropane tribehenate, pentaerythritol tetra-myristate, pentaerythritol tetrastearate, pentaerythritol tetra behenate, pentaerythritol diacetate dibehenate, glycerin tribehenate, 1,18-octadecanediol distearate, behenyl behenate, stearyl stearate, trimellitic acid tristearyl, distearyl maleate and the like (5) Amide-based waxes Ethylenediamine dibehenyl amide, trimellitic acid tristearyl amide and the like The content rate of a releasing agent is preferably 0 to 10 parts by mass relative to 100 parts by mass of the binder resin, and is more preferably 5 to 10 parts by mass.

(Magnetic Powder)

In the toner used in the image forming method of the present invention, examples of the magnetic powder include magnetite, γ-hematite, various ferrites and the like.

The content rate of a magnetic powder agent is preferably 10 to 500 parts by mass relative to 100 parts by mass of the binder resin, and is more preferably 20 to 200 parts by mass.

(Charge Control Agent)

In the toner used in the image forming method of the present invention, a charge control agent is not particularly limited as long as the charge control agent can provide positive charge or negative charge through frictional charging. Various known positive charge control agents and negative charge agents can be used.

The content rate of a charge control agent is preferably 0.1 to 10 parts by mass relative to 100 parts by mass of the binder resin, and is more preferably 0.5 to 5 parts by mass.

(External Additives)

In the toner used in the image forming method of the present invention, although the toner can be used as toner as is, in order to improve fluidity, electrostatic property, cleaning ability and the like, the toner particles can be used with so-called external additives such as a fluidizer and a cleaning aid added thereto.

Examples of the fluidizer includes inorganic particulates formed of silica, alumina, titanium oxide, zinc oxide, iron oxide, copper oxide, lead oxide, antimony oxide, yttrium oxide, magnesium oxide, barium titanate, ferrite, red iron oxide, magnesium fluoride, silicon carbide, boron carbide, silicon nitride, nitride zirconium, magnetite, magnesium stearate and the like.

These inorganic particulates are preferably subjected to surface processing in order to enhance dispersibility on the surface of the toner particles and environmental stability by using a silane coupling agent, a titanate coupling agent, a higher fatty acid, silicone oil and the like.

Examples of the cleaning aid include polystyrene particles, poly(methyl methacrylate) fine particles, and the like.

The external additives can be used in combination of various external additives.

The number average primary particle size of the external additive is preferably 30 nm or less.

The content rate of an external additive is preferably 0.05 to 5 parts by mass relative to 100 parts by mass of the toner particles, and is more preferably 0.1 to 3 parts by mass.

Examples of methods of manufacturing the toners described above include drying methods such as a powder grinding method, and wet methods such as an emulsification association method, a dissolution desolvation method and a dissolution suspension method.

[Dry Developer]

The developer used in the image forming method of the present invention is a dry type, and may be a one-component developer including a magnetic or non-magnetic toner or a two-component developer formed by mixing the toner and a carrier.

When the two-component developer is used, there can be used, as the carrier, magnetic particles including a conventionally known material such as iron, ferrite or magnetite and such as an alloy of a metal such as iron, ferrite ormagnetite and a metal such as aluminum or lead, and in particular, ferrite particles are preferable. Moreover, there may be used, as the carrier, a resin coating carrier in which the surface of the magnetic particles is coated with a coating agent such as a resin, a dispersion-type carrier obtained by dispersing magnetic particulate powder in a binder resin, or the like.

The carrier particle has a volume-based median diameter of preferably 15 to 100 μm, and more preferably 20 to 80 μm.

In the present invention, the volume-based median diameter of the carrier can be typically measured with a laser diffraction type particle size distribution measurement device "HELOS" (manufactured by SYMPATEC Co., Ltd.) provided with a wet disperser.

[Transfer Step]

The transfer step is a step in which the toner image is transferred to the image support.

The transfer of the toner image to the image support is performed by carrying out peeling electrification of the toner image on the image support.

As transfer means, for example, a corona transfer unit using corona discharge, a transfer belt, a transfer roller and the like can be used.

Furthermore, the transfer step can be performed by, for example, a mode in which, through the use of an intermediate transfer body, the toner image is primarily transferred onto the intermediate transfer body and then secondarily transferred onto the image support, a mode in which the toner image formed on the electrostatic latent image is directly transferred to the image support, or the like.

The image support is not particularly limited, and examples thereof include various types such as plain paper, high-quality paper and art paper ranging from thin paper to thick paper, coated printing paper such as coat pater, commercially available Japanese paper and postcard paper, plastic film for OHP, and cloth.

[Fixing Solution Supply Step]

The fixing solution supply step is a step in which the fixing solution is supplied to the toner image transferred to the image support, and the fixing solution used is set as the fixing solution of the present invention.

In this fixing solution supply step, the fixing solution supply means described above supplies the fixing solution of the present invention by injecting, spraying or applying it in the form of a liquid or a foam.

In the image forming method of the present invention, through the use of the line-type inkjet nozzle described above as the fixing solution supply means, the fixing solution is preferably supplied with the liquid droplet size ranging from 0.5 to 50 pl.

The image forming method of the present invention can be performed with, for example, an image forming device described below.

FIG. 6 is a schematic diagram showing an example of the configuration of the image forming device used in the image forming method of the present invention.

This image forming device 10 is a tandem full-color image forming device, and there are provided a plurality of image formation units 30Y, 30M, 30C and 30K provided along a belt-shaped intermediate transfer body 20, secondary transfer means 40 that transfers the toner image formed on the intermediate transfer body 20 by each image formation unit to the image support P, and fixing solution supply means 50 that supplies the fixing solution to the toner image transferred onto the image support P.

The image formation unit 30Y forms a yellow toner image, includes a drum-shaped photoreceptor 31Y that is an electrostatic latent image carrier, and it is configured such that charging means 32Y, exposure means 33Y, developing means 34Y, primary transfer means 35Y and cleaning means 36Y are arranged around the photoreceptor 31Y described above.

The image formation units 30M, 30C and 30K have the same configuration as the image formation unit 30Y except that they respectively forms magenta, cyan and black toner images instead of forming the yellow toner image.

The intermediate transfer body 20 is placed over a plurality of support rollers 21A, 21B and 21C, and is supported such that the intermediate transfer body 20 can move cyclically.

The secondary transfer means 40 includes a transfer unit that carries out peeling electrification of the toner image on the image support P and transfers the image to the image support P.

The fixing solution supply means 50 supplies the fixing solution in the form of liquid droplets to the toner image, and includes, for example, a line-type inkjet nozzle.

In this image forming device 10, the following image formation processing is performed.

When, in the image formation unit 30Y, the photoreceptor 31Y is driven and rotated, the charging means 32Y provides a uniform potential on the surface of the photoreceptor 31Y by using a corona discharge with the same polarity as the toner. An electrostatic latent image is formed on the surface of the uniformly charged photoreceptor 31Y on the basis of image data, by performing scanning parallel to the rotational direction of the photoreceptor 31Y and performing exposure through the exposure means 33Y. Then, through the developing means 34Y, the toner charged with the same polarity as the surface potential of the photoreceptor 31Y adheres to the electrostatic latent image of the photoreceptor 31Y, to thereby perform reversal development, and thus the toner image is formed and is transferred onto the cyclically moving intermediate transfer body 20 through the primary transfer means 35Y. The processing described above is also performed in the image formation units 30M, 30C and 30K, and thus the toner images of the respective colors formed by the respective image formation units 30Y, 30M, 30C and 30K are superimposed on the intermediate transfer body 20 to form a color toner image. This color toner image is secondarily transferred by the secondary transfer means 40 onto the image support P transported at a predetermined timing. Then, the fixing solution supply means 50 supplies, on the basis of the image data, the fixing solution to the toner image secondarily transferred to the image support P. The toner image to which the fixing solution is supplied is fixed to form an image.

In contrast, after the color toner image is transferred to the image support P by the secondary transfer means 40, the cleaning means 60 removes the untransferred toner remaining on the intermediate transfer body 20 which curvature-separates the image support P. In addition, the cleaning means 36Y, 36M, 36C and 36K respectively remove the untransferred toner remaining on the photoreceptors 31Y, 31M, 31C and 31K.

According to the image forming method of the present invention, in a wet fixing system, through the use of the fixing solution of the present invention, faster fixing rate and faster drying rate is realized while the amount of fixing solution supplied is reduced, and furthermore, a wet feeling is reduced on the formed image and an image having high fixing strength can be formed.

EXAMPLES

Production Example 1 of the Toner (1) Preparation of a Binder Resin Particle Dispersion Solution In a reaction container having an agitation device, a temperature sensor, a cooling tube and a nitrogen introduction device, 4 parts by mass of polyoxyethylene-2-dodecyl ether sodium sulfate was put together with 3040 parts by mass of ion exchange water, and thus a surfactant aqueous solution was prepared and its internal temperature was increased to 80° C. while being agitated at an agitation speed of 230 rpm under nitrogen streams. To the surfactant aqueous solution described above, a polymerization initiator solution obtained by dissolving 10 parts by mass of potassium persulfate in 400 parts by mass of ion exchange water was added, the temperature was increased to 75° C. and thereafter a monomer solution formed with 479 parts by mass of styrene, 144 parts by mass of n-butyl acrylate, 77 parts by mass of methacrylic acid and 9 parts by mass of n-octylmercaptan was dropped into the reaction container for one hour. After the dropping, the resultant substance was polymerized by being heated and agitated at 75° C. for two hours, and thus there was prepared a binder resin particle dispersion solution [1] in which binder resin particles formed of styrene-acryl based resin were dispersed. The glass transition temperature of the binder resin particles produced was 56° C., and the weight-average molecular weight thereof was 23,000.

(2) Preparation of a Coloring Agent Particle Dispersion Solution

While a surfactant aqueous solution obtained by dissolving 90 parts by mass of dodecyl sodium sulfate in 1600 parts by mass of ion exchange water was being agitated, there was prepared a coloring agent particle dispersion solution [1] where coloring agent particles were dispersed by gradually adding 400 parts by mass of a carbon black "Regal 330" (manufactured by Cabot Corporation) and performing dispersion processing through the use of an agitation device "Clearmix" (manufactured by M TECHNIQUE Co., Ltd). The coloring agent particles were measured through the use of an electrophoresis light scattering photometer "ELS-800" (manufactured by Otsuka Electronics Co., Ltd.), and consequently, the volume-based median diameter of the particles was 110 nm.

(3) Preparation of the Toner Particles

In a reaction container including an agitation device, a temperature sensor, a cooling tube and a nitrogen introduction device, 420 parts by mass (in terms of solid content) of the binder resin particle dispersion solution [1], 900 parts by mass of ion exchange water and 200 parts by mass of the coloring agent particle dispersion solution [1] were put and agitated. The internal temperature of the container was adjusted to be 30° C., and then 5 mole/liter of an aqueous sodium hydroxide solution was added such that its pH was adjusted to be 8 to 11.

Then, an aqueous solution obtained by dissolving 2 parts by mass of magnesium chloride hexahydrate in 1000 parts by mass of ion exchange water was added under agitation at 30° C. for 10 minutes. The resultant substance was left for 3 minutes and the temperature thereof started to be increased, this system was increased to 65° C. for 60 minutes, and thus association between the binder resin particles and the coloring agent particles was performed.

In this state, through the use of "Coulter Multisizer 3" (manufactured by Coulter, Inc.) the size of the associated particles was measured, and when the volume-based median diameter reaches 6.3 μm, an aqueous solution obtained by dissolving 40.2 parts by mass of sodium chloride in 1000 parts by mass of ion exchange water was added to stop the association.

Thereafter, as aging processing, the liquid temperature was changed to 70° C., heating and agitation were performed for one hour and thus fusion was continued. At this time, the average degree of circularity of the particles was measured through the use of "FPIA2100" (made by SYSMEX Corporation), and its result was 0.960. Furthermore, it was cooled to 30° C. at a rate of 8° C./minute, was filtered, was repeatedly washed with ion exchange water of 45° C. and was dried with hot air of 40° C., with the result that the toner particles [1] was obtained. The volume-based median diameter of the toner particles [1] was 6.5 μm.

To 100 parts by mass of the obtained toner particles [1], one mass part of hydrophobic silica was added, and the resultant substance was mixed through the use of a Henschel mixer. The circumferential velocity of the rotary blade was set at 24 m/s, and they were mixed for 20 minutes and thereafter were passed through a sieve of 400 MESH, with the result that the toner [1] was obtained.

Production Example 2 of the Toner

In a reaction container including a cooling tube, there were put an agitator and a nitrogen introduction tube, 675 parts by mass of 2 mole bisphenol A ethylene oxide adduct, 88 parts by mass of 2 mole bisphenol A propylene oxide adduct, 281 parts by mass of terephthalic acid, 31 parts by mass of trimellitic anhydride and 2 parts by mass of dibutyltin oxide were put, and the resultant substance was caused to react under a normal pressure at 230° C. for 7 hours and were made to react under a reduced pressure of 10 to 15 mmHg for 5 hours, with the result that a polyester resin [1] was obtained.

The glass transition temperature of the polyester resin [1] was 54° C., and the weight-average molecular weight thereof was 10,000.

1500 parts by mass of ethyl acetate was added to 370 parts by mass of the polyester resin [1] and 45 parts by mass of the carbon black "Regal 330" (manufactured made by Cabot Corporation), and the temperature of the resultant substance was increased to 75° C. while being agitated, and thereafter, the resultant substance was agitated at 75° C. for 3 hours, with the result that a resin solution [1] having a solid content concentration of 25% by mass was obtained.

A solution obtained by dissolving and dispersing, in 580 parts by mass of pure water, 5 parts by mass of tricalcium phosphate as a dispersing agent and 0.05 mass part of sodium dodecyl benzene sulfonate as a dispersing stabilizer was agitated at 5000 rpm for 15 minutes through the use of "TK homomixer" (manufactured by PRIMIX Corporation), with the result that a milky white aqueous medium [1] was obtained.

600 parts by mass of the resin solution [1] was added to the aqueous medium [1], and the resultant substance was agitated at 12000 rpm for 30 minutes with the "TK homomixer", with the result that an oil droplet particle dispersing solution [1] was prepared.

The oil droplet particle dispersing solution [1] was transferred to a reduced-pressure distillation device, and methyl ethyl ketone that is a water-insoluble organic solvent, was removed at a reduced pressure. One mole/liter of hydrochloric acid was added to the resulting slurry until the pH of the slurry reached 1, the slurry was left for 30 minutes, and tricalcium phosphate was removed from the surface of the resin particles. Thereafter, filtration, washing and drying were performed, with the result that toner particles [2] having a volume-based median diameter of 5.2 μm were obtained.

One mass part of hydrophobic silica was added to 100 parts by mass of the obtained toner particles [2], and the resultant substance was mixed through the use of the Henschel mixer. After mixing for 20 minutes at the circumferential velocity of the rotary blade of 24 m/s, the resultant substance was passed through the sieve of 400 MESH, with the result that the toner [2] was obtained.

Production Examples 1 to 2 of the Dry Developer

Each of the toners [1] to [2] and a ferrite carrier being coated with a silicone rein and having a volumetric average diameter of 60 nm were mixed, and dry developers [1] to [2] each having a toner concentration of 6% by mass were produced.

Example 1 of Preparation of the Fixing Solution

Fifteen parts by mass of hydroxypropyl caprylate was added as a softening agent to 84 parts by mass of ion exchange water obtained by dissolving 1 mass part of a surfactant (sodium myristate), and the resultant substance was then agitated with an ultrasonic homogenizer for five minutes, with the result that a fixing solution [1] was prepared.

Example 2 of Preparation of the Fixing Solution

Forty parts by mass of hydroxypropyl caprylate was added as a softening agent to 56 parts by mass of ion exchange water obtained by dissolving 4 parts by mass of a surfactant (sodium myristate), and the resultant substance was then agitated with an ultrasonic homogenizer for five minutes, with the result that a fixing solution [2] was prepared.

Examples 3 to 8 of Preparation of the Fixing Solution

Fixing solutions [3] to [8] were prepared in the same manner as in Example 1 of preparation of the fixing solution except that the softening agent was changed to each of the softening agents shown in table 1.

Example 9 of Preparation of the Fixing Solution

Fifteen parts by mass of hydroxypropyl caprylate was added as a softening agent to 85 parts by mass of isoparaffin serving as diluent, and the resultant substance was then agitated with a stirrer for five minutes, with the result that a fixing solution [9] was prepared.

Example 10 of Preparation of the Fixing Solution

Without the use of a diluent agent and a surfactant, a fixing solution [10] formed with 100 parts by mass of hydroxypropyl caprylate serving as a softening agent was prepared.

TABLE 1

| Fixing solution | Softening agent No. In general formula (1) | | |
|---|---|---|---|
| No. | $R^1$ | | $R^2$ |
| (1) | $CH_3CH_2CH_2CH_2CH_2CH_2CH_2$ | n = 7 | $CH_2CH(OH)CH_3$ |
| (2) | $CH_3CH_2CH_2CH_2CH_2CH_2CH_2$ | n = 7 | $CH_2CH(OH)CH_3$ |
| (3) | $CH_3CH_2CH_2CH_2CH_2CH_2$ | n = 6 | $CH_2CH(OH)CH_3$ |
| (4) | $CH_3CH_2CH_2CH_2CH_2CH_2CH_2CH_2CH_2CH_2CH_2$ | n = 11 | $CH_2CH(OH)CH_3$ |
| (5) | $CH_3CH_2CH_2CH_2CH_2CH_2CH_2CH_2CH_2CH_2CH_2CH_2$ | n = 12 | $CH_2CH(OH)CH_3$ |
| (6) | $CH_3CH_2CH_2CH_2CH_2CH_2CH_2$ | n = 7 | $CH_2CH_2(OH)$ |
| (7) | $CH_3CH_2CH_2CH_2CH_2CH_2CH_2$ | n = 7 | $CH_2CH_2OH(OH)CH_3$ |
| (8) | $CH_3CH_2CH_2CH_2CH_2CH_2CH_2$ | n = 7 | $CH_2CH_2CH_2$ |
| (9) | $CH_3CH_2CH_2CH_2CH_2CH_2CH_2$ | n = 7 | CH2CH(OH)CH3 |
| (10) | $CH_3CH_2CH_2CH_2CH_2CH_2CH_2$ | n = 7 | $CH_2CH(OH)CH_3$ |

| Fixing solution No. | Softening agent No. In general formula (1) $R^2$ | Content (% by mass) | Diluent agent | Surfactant |
|---|---|---|---|---|
| (1) | n = 3(β position) | 15 | Ion exchange water | Myristate Na |
| (2) | n = 3(β position) | 40 | Ion exchange water | Myristate Na |
| (3) | n = 3(β position) | 15 | Ion exchange water | Myristate Na |
| (4) | n = 3(β position) | 15 | Ion exchange water | Myristate Na |
| (5) | n = 3(β position) | 15 | Ion exchange water | Myristate Na |

TABLE 1-continued

| | | | | |
|---|---|---|---|---|
| (6) | n = 2(β position) | 15 | Ion exchange water | Myristate Na |
| (7) | n = 4(δ position) | 15 | Ion exchange water | Myristate Na |
| (8) | n = 3(Without OH) | 15 | Ion exchange water | Myristate Na |
| (9) | n = 3(β position) | 15 | Isoparaffin | None |
| (10) | n = 3(β position) | 100 | None | None |

Examples 1 to 16, Comparative Examples 1 to 4

The heating fixing unit of an image forming device "bizhub C 253" (manufactured by Konica Minolta Business Technologies, Inc.) was removed, a fixing unit [1] shown below was mounted, and the dry developer and the fixing solution were used in accordance with combinations thereof shown in table 2, with the result that a solid image was formed on an image support "J paper" (manufactured by Konica Minolta, Inc.) at a toner adhesion amount of 4 g/m$^2$. The following evaluation was performed on the obtained solid image. The results are shown in table 2. In this image formation, the fixing was performed without heating.

Fixing Unit [1]

The fixing unit [1] is configured with fixing solution supply means including a line-type inkjet nozzle as shown in FIG. 2

The line-type inkjet nozzle constituting the fixing solution supply means has a resolution of 600 dpi and a liquid droplet size of 10 to 15 pl.

The set supply amount of fixing solution is 0.1 g/A4.

The pressurizing force of the pressure application means is 200 kPa.

<Evaluation of a Wet Feeling after Chronological Leaving>

The formed solid image portion, a non-image portion and the solid image portion were stacked so as to face each other, a weight was placed such that the weight corresponds to 80 g/cm$^2$ with respect to the stacked portion, and they were left for 30 minutes in a constant temperature and humidity chamber maintained at a temperature of 25° C. and at a humidity of 30%. The degree of image defects of the two stacked fixed images after being left is graded into 5 levels of "G1" to "G5" shown below. Note that the levels of G3 or more are levels in which there is no problem in practical use.

G1: Since the image portions adhere to each other, paper itself to which the images are fixed peels off, image defects are intense, and it can be obviously seen that the image is shifted to the non-image portion.

G2: Since the images adhere to each other, white spots being image defects are generated in some parts of the image portions.

G3: When the two stacked images are separated, although image roughness and gloss decrease are generated on the fixing surfaces thereof, there are almost no image defects, and even image defects present are allowable. The image is found to be slightly shifted to the non-image portion.

G4: When the two stacked images are separated, although the crack sound is made and the image is found to be slightly shifted to the non-image portion, there are no image defects without any problem at all.

G5: There are no image defects and image shift at all both in the image portions and non-image portion.

<Rubbing Fixing Rate>

Five seconds after the fixing, the surface of the solid image was rubbed with a piece of cotton cloth having a diameter of 1 cm, and the reflected density thereof was measured before and after the rubbing with "RD-918" (manufactured by Macbeth Co., Ltd). Through the use of the following formula (1), the rubbing fixing rate was calculated, and evaluation was performed on the basis of the following evaluation criteria. When the rubbing fixing rate is 70% or more, there is no problem in practical use.

rubbing fixing rate (%)={reflected density after rubbing/reflected density before rubbing (1.40)}×100 Formula (1):

TABLE 2

| | Developer No. | Fixing solution No. | Evaluation: Wet feeling (rank) | Evaluation: Rubbing fixing rate (%) |
|---|---|---|---|---|
| Example 1 | [1] | [1] | G5 | 91 |
| Example 2 | [1] | [2] | G3 | 90 |
| Example 3 | [1] | [3] | G3 | 85 |
| Example 4 | [1] | [4] | G5 | 75 |
| Example 5 | [1] | [6] | G4 | 89 |
| Example 6 | [1] | [7] | G5 | 79 |
| Example 7 | [1] | [9] | G4 | 82 |
| Example 8 | [1] | [10] | G3 | 84 |
| Example 9 | [2] | [1] | G4 | 85 |
| Example 10 | [2] | [2] | G3 | 82 |
| Example 11 | [2] | [3] | G4 | 81 |
| Example 12 | [2] | [4] | G3 | 74 |
| Example 13 | [2] | [6] | G4 | 76 |
| Example 14 | [2] | [7] | G4 | 74 |
| Example 15 | [2] | [9] | G5 | 75 |
| Example 16 | [2] | [10] | G3 | 86 |
| Comparative example 1 | [1] | [5] | G2 | 61 |
| Comparative example 2 | [1] | [8] | G2 | 58 |
| Comparative example 3 | [2] | [5] | G2 | 59 |
| Comparative example 4 | [2] | [8] | G2 | 55 |

DESCRIPTION OF THE SYMBOLS

10 image forming device
20 intermediate transfer body
21A, 21B, 21C support roller
30Y, 30M, 30C, 30K image formation unit
31 toner image carrier
31Y, 31M, 31C, 31K photoreceptor
32Y, 32M, 32C, 32K charging means
33Y, 33M, 33C, 33K exposure means
34Y, 34M, 34C, 34K developing means
35Y, 35M, 35C, 35K primary transfer means
36Y, 36M, 36C, 36K cleaning means
40 secondary transfer means
50, 50A, 50B, 50C, 50D fixing solution supply means
51 fixing solution coating roller
52 pressurizing roller
53 metalling blade
54 foam generation device
55 fixing solution coating roller
56 pressurizing roller
57 regulation blade

60 cleaning means
70 pressure application means
B foamed film
F fixing solution
M liquid film
T toner image
P image support

What is claimed is:

1. An image forming method comprising:

an electrostatic latent image formation step of forming an electrostatic latent image on an electrostatic latent image carrier;

a development step of forming a toner image by developing the electrostatic latent image with a dry developer including a toner, wherein the toner comprises a binder resin;

a transfer step of transferring the toner image to an image support; and a fixing solution supply step of supplying a fixing solution to the toner image transferred to the image support, wherein the fixing solution contains a softening agent and a dispersing agent for the toner, and the softening agent is a hydroxyl group-containing ester compound expressed by general formula (1) below:

$$R^1—(CO)—O—R^2 \qquad \text{general formula (1):}$$

where $R^1$ represents a linear branched alkyl group having 6 to 11 carbon atoms, and $R^2$ represents a linear or branched alkyl group having at least one hydroxyl group and 2 to 4 carbon atoms.

2. The image forming method according to claim 1, wherein, in the fixing solution supply step, a line-type inkjet nozzle is used to supply the fixing solution having a liquid droplet size ranging from 0.5 to 50 pl.

3. The image forming method according claim 1, wherein the binder resin is a styrene-methacrylic resin or a styrene-acrylic resin.

4. The image forming method according to claim 1, wherein, in the general formula (1), $R^1$ is a linear or branched alkyl group having 6 to 9 carbon atoms.

5. The image forming method according to claim 1, wherein, in the hydroxyl group-containing ester compound expressed by the general formula (1), $R^2$ in the general formula (1) has one hydroxyl group, and the hydroxyl group is in a βposition with respect to an oxycarbonyl group.

6. The image forming method according to claim 1, wherein the hydroxyl group-containing ester compound expressed by the general formula (1) is hydroxypropyl caprylate.

7. The image forming method according to claim 1, wherein the fixing solution further comprises water and a surfactant.

8. The image forming method according to claim 7, wherein the surfactant is at least one selected from the group consisting of sodium laurate, sodium myristate, sodium oleate, sodium dodecyl benzene sulfonate, sodium lauryl sulfate, sodium polyethoxyethylene lauryl ether sulfate, sodium polyoxyethylene nonylphenyl ether sulfate, sodium monooctyl sulfosuccinate, sodium dioctyl sulfosuccinate, sodium polyoxyethylene lauryl sulfosuccinate, benzethonium chloride, polyoxyethylene lauryl ether, polyoxyethylene stearyl ether, polyoxyethylene nonylphenyl ether, sorbitan monolaurate, sorbitan monostearate, sorbitan trioleate, polyoxyethylene sorbitan monolaurate, polyoxyethylene monolaurate, polyoxyethylene monostearate, oleate monoglyceride, and stearic acid monoglyceride.

9. The image forming method according to claim 7, wherein a content of the surfactant is 1 to 5% by mass relative to the fixing solution.

10. The image forming method according to claim 1, wherein the softening agent dissolves the binder resin after the fixing solution is supplied to the toner image.

11. The image forming method according to claim 1, wherein the fixing solution consists of the hydroxyl group-containing ester compound expressed by the general formula (1), the dispersing agent, and a diluent agent.

* * * * *